US005542367A

United States Patent [19]

DuBois, III et al.

[11] Patent Number: 5,542,367

[45] Date of Patent: Aug. 6, 1996

[54] PORTABLE BOAT DOCKING DEVICE AND METHOD FOR USING THE SAME

[75] Inventors: Eugene W. DuBois, III, Wellesley; Ronald J. Doria, Watertown; Robert J. Butler, Andover, all of Mass.

[73] Assignee: Incon Marine, Inc., Hudson, N.H.

[21] Appl. No.: 390,752

[22] Filed: Feb. 17, 1995

[51] Int. Cl.[6] ..... B63B 21/04

[52] U.S. Cl. ..... 114/218

[58] Field of Search ..... 114/230, 218; 411/549, 551, 553; 410/116

[56] References Cited

U.S. PATENT DOCUMENTS

| | | | |
|---|---|---|---|
| 2,228,760 | 1/1941 | Funk | 411/549 |
| 2,833,240 | 5/1958 | Semolic | 114/218 |
| 2,991,046 | 4/1961 | Parsons | 114/218 |
| 3,703,875 | 11/1972 | Gunvalson | 114/230 |
| 4,297,963 | 11/1981 | Beacom | 114/230 |
| 4,344,378 | 8/1982 | Martin | 114/218 |
| 5,076,748 | 12/1991 | Waterfield et al. | 411/551 |

*Primary Examiner*—Sherman Basinger
*Attorney, Agent, or Firm*—Bromberg & Sunstein

[57] ABSTRACT

A boat docking device comprising a base plate, a cleat attached to the base plate, two openings disposed at opposite ends of the base plate through which two bolts extend, and two nuts. Each bolt includes an engaging end portion around which a nut engages, and a stop end portion through which a bar is perpendicularly situated for engaging the underside of a plank dock. The bolts along with their respective bars are capable of being placed through a gap between two dock planks. The bolts may thereafter be axially rotated so that the bars are perpendicular to the gap. Subsequently, the nuts may be tightened so as to pull the bars securely against the underside of the dock planks.

14 Claims, 3 Drawing Sheets

PORTABLE BOAT DOCKING DEVICE AND METHOD FOR USING THE SAME

TECHNICAL FIELD

The present invention generally relates to docking devices, and in particular, to portable docking cleats and methods for using the cleats.

BACKGROUND ART

A marina typically has docks and moorings to which a boat may be secured when it is not in use. Near the edge of a plank dock, for example, lines and docking cleats are sometimes made available for the convenience of a boat owner. In many instances, docking cleats provide the only adequate securing points to which a boat may wrap or tie its lines. To this end, docking cleats are often permanently attached directly onto the dock so that in conditions which may otherwise cause concern, the boat may be safely secured. However, docking cleats may not always be conveniently located, accessible or available for securing purposes.

For instance, as a dock may only have a specific number of cleats attached thereto, not every boat may be immediately accommodated. In particular, at a favorite docking location, cleats that are positioned for easy access are often being used by others to secure their boats. If one is available, more often than not, it is because the cleat is too distantly located from where a boat owner may want to be. As a result, the cleat is often left unused as a more conveniently located one is searched out in frustration.

Convenience may not always be the problem. Often, upon pulling into a dock, an unoccupied docking cleat may quickly be sighted. However, as the approach is made, previously unseen obstacles may subsequently arise. For example, another boat may have since positioned itself in front of the available cleat. More likely however, lines extending from another boat may now be clearly seen across the path to the cleat. Whichever the situation may be, the realization that the docking cleat cannot be accessed because the bow or stern line currently available on board is not of sufficient length may also prove frustrating.

Even when a bow or stern line is of sufficient length, an attempt to dock may still be frustrating if the dock is not equipped with cleats. On occasions, cleats are intentionally not mounted for safety reasons, most notably, to avoid accidental tripping. In the absence of docking cleats, a nearby structure, such as a dock support column, a post or a tree branch, may sometime be used to secure a boat. However, neither the support column, the post nor the tree branch is specifically designed to securely receive a line.

Additionally, in conditions which may otherwise cause concern, it may be desirable to use more than one cleat to provide added security when docking a boat. Yet this may not always be possible when a dock is not equipped with a sufficient number of docking cleats.

At present, only docking devices that are intended as permanent attachments are commercially available for safely securing a boat. In other words, these devices cannot be easily and conveniently attached or removed from a plank dock once they are mounted. As an illustration, when attaching a conventional docking cleat to, for example, a wooden plank dock, openings must first be drilled through the wooden planks so that they align with holes in the base of the cleat. Subsequently the attaching bolts must be maneuvered through not only the base holes, which typically are directly beneath the extending arms of the cleat, but also the openings in the planks before the cleat can be secured against the wooden planks. Once secured, the cleat may be very difficult and inconvenient to remove so that it may be used elsewhere. Specifically, the appropriate tools may not always be available for removing the cleat. Moreover, over time, the wooden planks may have warped and the nuts and bolts may have rusted thereby making removal more difficult. Furthermore, as a conventional docking cleat generally can only be secured from the underside of the dock, removal must also be from the underside of the dock. However, this may not always be possible. In particular, during high tide, the water level may rise to a point at which access is impossible.

Along with these difficulties, the permanent attachment of a docking cleat may also be expensive. For instance, when a docking cleat is not available at an often-visited dock, a boat owner may wish to permanently install a cleat for future use. A permanently installed cleat, as explained above, is not very easily removed for use elsewhere. Thus, in the event that another cleat is needed at a different dock, a new one must be provided.

Accordingly, when approaching a wooden dock where the device for securing a boat is inconveniently located, inaccessible or unavailable, the availability and access to a docking cleat that can provide a safe and adequate securing point, and be conveniently attached, yet easily removed for use elsewhere would be highly desirable.

SUMMARY OF THE INVENTION

The device that is the subject of the present invention provides a point around which a bow line, stern line or spring line may be wrapped or tied so that a boat may be secured against a dock. Specifically, the device is provided with a base plate having a top surface, a bottom surface, and two spatially opposed openings extending from the top surface to the bottom surface of the base plate. A cleat, joined with the top surface of the base plate, is disposed between the two openings. Two bolts, each having a receiving end portion and a stop end portion, are constructed for mutual engagement with two nuts about the receiving end portions. Each bolt is situated across one opening whereby the receiving end portion is projected upward. The stop end portion of each bolt, being adjacent to the bottom surface of the base plate, includes a bar that is relatively perpendicular to the bolt.

Upon securing the device of the present invention to a plank dock, the bar at the stop end portion of each bolt is first aligned with a gap between two dock planks. The bolts are then inserted through the gap and axially rotated so as to allow each bar to be substantially perpendicular to the gap beneath the dock planks. Thereafter, as each nut is advanced downward along the bolt, the bolt tends to move upward relative to the nut so as to pull the bar toward the underside of the dock planks. Once the dock planks are firmly sandwiched between the bar and the base plate, a line may be secured around the cleat. The securing process may be easily reversed for removal of the docking device from the dock planks.

DETAILED DESCRIPTION OF SPECIFIC EMBODIMENTS

The boat docking device in accordance with the present invention comprises a base plate, a cleat attached to the base plate, two openings disposed at opposite ends of the base plate through which two bolts extend, and two nuts capable of mutually engaging the bolts.

Figure 1:
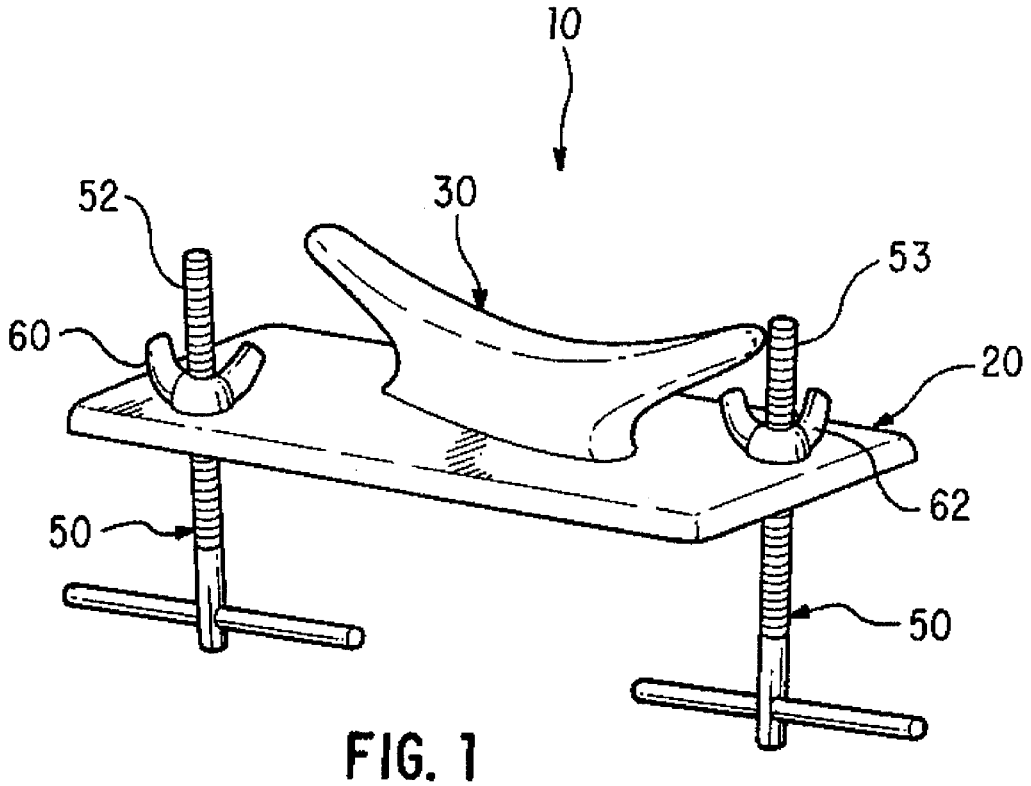
FIG. 1 is a perspective view of one embodiment of a boat docking device of the present invention.
Figure 2:
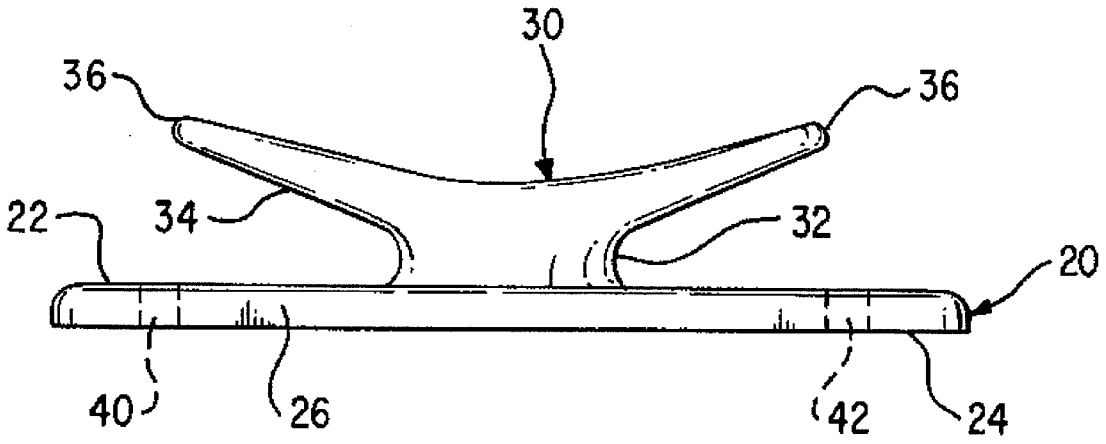
FIG. 2 shows, in side view, a base plate and a cleat of the boat docking device illustrated in FIG. 1.

In FIG. 1, one embodiment of a boat docking device 10 is shown. The docking device 10, made of a rigid metallic material, is provided with a base plate 20 of uniform thickness. The base plate 20 is planar in shape and, as shown in FIG. 2, includes a top surface 22 and a bottom surface 24. The base plate 20, being substantially flat at its bottom surface 24, is adapted to evenly engage the upper side of a plank dock and to provide the docking device 10 with stability when the docking device 10 is in use. In one embodiment, the bottom surface 24 may be provided with generally sharp downward projections. In this way, base plate 20 may dig into the plank dock and enhance its engagement thereto. A border 26 forms a periphery around base plate 20. Border 26 is situated between the top surface 22 and the bottom surface 24 such that the border 26 and the bottom surface 24 are perpendicular to one another. Similarly, the border 26 and the top surface 22 may meet at a juncture to form a right angle relative to one another. It is preferred, however, that the border 26 be beveled at the juncture to eliminate sharp edges which may cut into a boat line moving against the base plate 20. While base plate 20 has border 26 that may define any desired shape, a rectangular shape, as illustrated in FIG. 1, is preferred.

In FIG. 2, a conventionally shaped cleat 30 is shown firmly attached to the top surface 22 of base plate 20. In a preferred embodiment, cleat 30 is integrally molded with the base plate 20 to strengthen the connection between the cleat and the base plate. Cleat 30, constructed of a metallic material, comprises an engaging portion 32 for firmly engaging the top surface 22, and a securing portion 34 for securing lines from a boat. The securing portion 34 includes divergent arms 36 which are extended upwardly from the engaging portion 32. When cleat 30 is viewed directly from above, looking now at FIG. 3, divergent arms 36 are in straight alignment relative to one another such that the securing portion 34 is substantially longer than the engaging portion 32. In one embodiment of the invention, divergent arms 36 extend approximately two thirds the distance diagonally across base plate 20. With the long divergent arms 36, the securing portion 34 may provide a sufficient area around which a boat line may be secured. The engaging portion 32, on the other hand, is relatively wide in comparison to the securing portion 34. Thus, in the presence of a force perpendicular to cleat 30 (e.g. pulling force from a boat line), the width of the engaging portion 32 may provide cleat 30 with stability as cleat 30 is pulled in the direction of the force.

Cleat 30 is preferably positioned at a midpoint on base plate 20 whereby the divergent arms 36 are in general alignment with two diagonally opposing corners on base plate 20. In this diagonal position, divergent arms 36 preferably do not extend beyond border 26. Additionally, as is explained hereinafter, when a boat line such as a bow or stern line is wrapped around cleat 30, interference with adjustable means 50 may be avoided. Although the diagonal placement is preferred, cleat 30 may also be attached so that the divergent arms 36 are parallel to portions of border 26 comprising the length of the base plate 20. Similar to the diagonal placement, divergent arms 36, preferably do not extend beyond border 26 in the parallel position. By not extending beyond border 26, accidental scraping against the divergent arms 36 may be greatly reduced when boat docking device 10 is in use. Although only a few positions have been described herein, cleat 30 may be attached in any necessary position on base plate 20. Furthermore, cleat 30 may have divergent arms 36 of any proportionate length relative to base plate 20.

As the boat docking device 10 must withstand strong pulling forces, base plate 20 and cleat 30 are preferably manufactured from a rigid and strong metallic material that is capable of providing the boat docking device 10 with sufficient strength. By way of example, base plate 20 and cleat 30 may be constructed from solid aluminum. Base plate 20 and cleat 30 may also be constructed from commercially available stainless steel or cast iron. In the preferred embodiment, base plate 20 and cleat 30 are formed from a one piece solid aluminum cast such that cleat 30 is integral with the top surface 22 of base plate 20. Base plate 20 and cleat 30 may, however, be manufactured as two separate pieces which can subsequently be joined by any well known method in the industry. For instance, cleat 30 may be bolted or welded to base plate 20.

Figure 3:
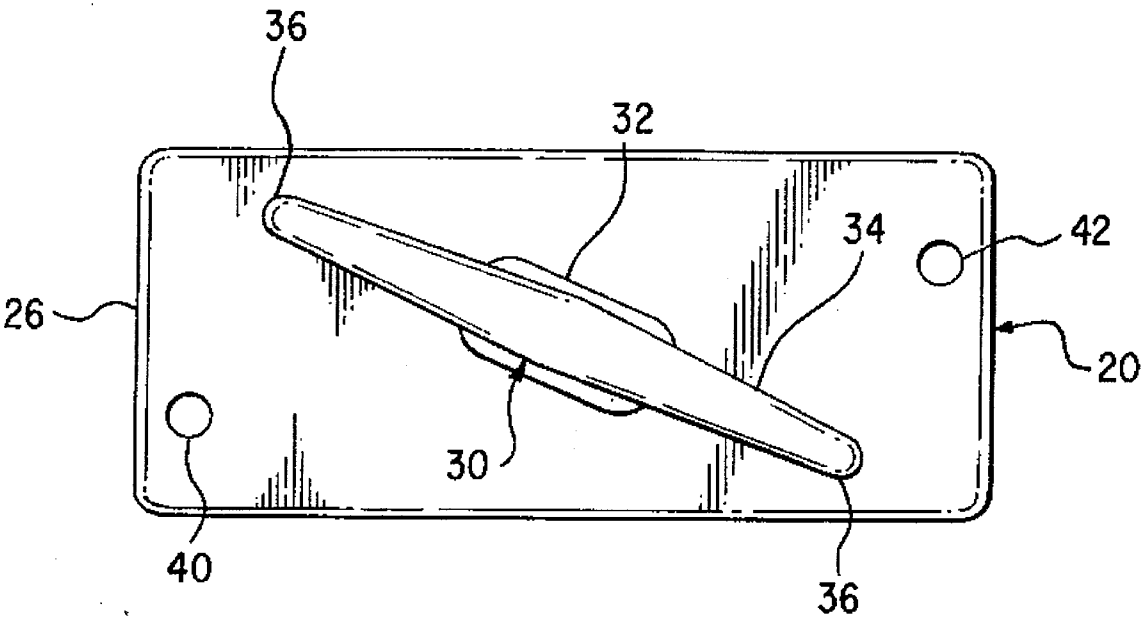
FIG. 3 is a top view of the base plate and cleat illustrated in FIG. 2.
Figure 4:
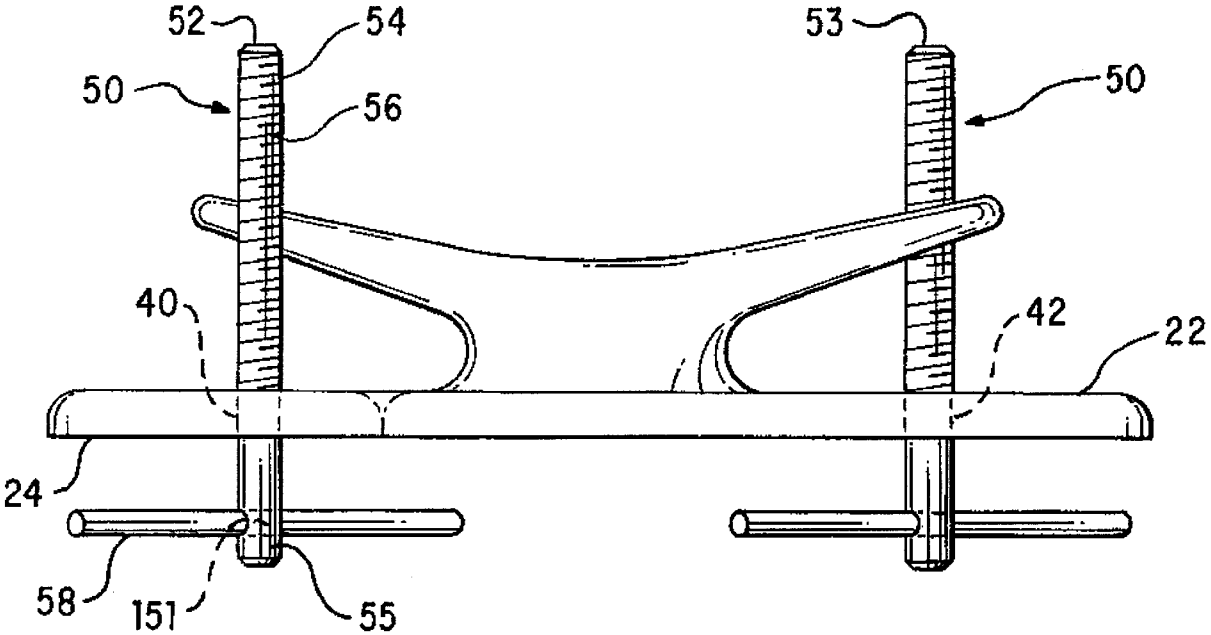
FIG. 4 shows, in side view, from one corner, a base plate, a cleat, and two bolts of the boat docking device illustrated in claim 1.

As illustrated in FIG. 3, two spatially opposed openings 40 and 42 are disposed at opposite ends of base plate 20 spaced away from cleat 30 such that cleat 30 is substantially between the openings. The openings 40 and 42, being relatively comparable in size, sit adjacent to border 26 and extend from the top surface 22 to the bottom surface 24 of the base plate 20 (FIGS. 2 and 4). Each of the openings 40 and 42 has a diameter slightly larger than the corresponding diameters of the adjustable means 50. In this manner, adjustable means 50 may easily move across each of the openings when the boat docking device 10 is secured against a plank dock. Furthermore, by being spaced away from cleat 30, openings 40 and 42 allow adjustable means 50 to avoid any interference with the divergent arms 36 as the adjustable means 50 maintain their positions in the openings. In the preferred embodiment, openings 40 and 42 are diagonally situated so that each opening is adjacent to each of two diagonally opposing corners not in alignment with the divergent arms 36 of cleat 30. Thus, when a line is drawn connecting the diagonally situated openings 40 and 42, the line diagonally intersects cleat 30. Openings 40 and 42 may also be situated at a midpoint between the two adjacent corners at each end of base plate 20. In this position, a line connecting openings 40 and 42 runs parallel to portions of border 26 which comprises the length of base plate 20. Openings 40 and 42 may also be placed adjacent to diagonally opposed corners having an alignment with divergent arms 36. This placement is only possible, however, if base plate 20 is substantially longer than cleat 30. Otherwise, divergent arms 36 may interfere with the ability of the adjustment means 50 to extend upwardly through the openings.

FIGS. 1 and 4 show adjustable means 50 for removably securing base plate 20 to a plank dock. In other words, adjustable means 50 is capable adjusting to the thickness of the plank dock and is adapted to easily and conveniently secure the base plate 20 from above the plank dock. Adjustable means 50 is also adapted to easily and conveniently remove the base plate 20 from the above plank dock. To accomplish this, adjustable means 50 comprises a pair of interchangeable elongated bolts 52 and 53 and mutually interchangeable nuts 60 and 62. Elongated bolts 52 and 53, similar to base plate 20 and cleat 30, are made of a strong metallic material such as commercially available stainless steel. Stainless steel is preferred since it is highly corrosion resistant when exposed to environmental conditions. As the boat docking device 10 of the present invention is made to be used in extreme conditions, bolts 52 and 53 are preferably corrosion resistant so that the docking device 10 may be secured and removed from the plank dock with ease. Alternatively, bolts 52 and 53 may be made from any other strong metallic material that is highly corrosion resistant.

For the ease of discussion, reference is now made only to bolt 52 with the understanding that the components hereinafter disclosed are similarly applicable to bolt 53. Elongated bolt 52 is generally cylindrical in shape and comprises a receiving end portion 54 and a stop end portion 55. Elongated bolt 52 further includes along its length, an external screw thread 56 for mutual engagement with nut 60. If desired, screw thread 56 may extend from the receiving end portion 54 substantially toward the stop end portion 55. However, because the thickness of dock planks may vary from dock to dock, it is preferred that the screw thread 56 extends along the entire length of elongated bolt 52 (FIG. 1). To this end, the docking device 10 may be firmly secured against any plank dock as screw thread 56 allows nut 60 to adjust to any position along the length of bolt 52 which corresponds to the thickness of the dock planks.

When the bolt 52 is respectively positioned within either of the openings 40 and 42, the receiving end portion 54 of bolt 52 extends upwardly through each opening so that the receiving end portion 54 is adjacent the top surface 22 of base plate 20. The stop end portion 55 of bolt 52, in contrast, remains adjacent to the bottom surface 24 of base plate 20. The stop end portion 55 includes a generally straight bar 58 perpendicularly situated relative to bolt 52 for engaging the underside of the plank dock. Bar 58, being attached at its midpoint to bolt 52, projects from bolt 52 in two directions. In one method of manufacture, bolt 52 may have an aperture 151 across its stop end portion 55 so that bar 58 may be firmly accommodated therethrough. Bar 58 may also be tightly secured within the aperture 151 by crimping bolt 52 against bar 58 at an area immediately adjacent the aperture. Bar 58 may alternatively be soldered within aperture 151 to prevent any displacement of bar 58 from the aperture. Viewed broadly, bar 58 is substantially longer than the diameter of the openings 40 and 42, while preferably slightly shorter then half the length of base plate 20. Thus, bar 58 can prevent bolt 52 from advancing across each opening.

Instead of extending through aperture 151, bar 58 may be firmly attached against the stop end portion 55 at its end surface using any well known method. By way of example, bar 58 may be welded or made integral with the end surface of the stop end portion 55 so that when engaging the underside of a dock plank, bar 58 may be firmly pulled against the dock plank by bolt 52. Bar 58 may also have any configuration when projecting from bolt 52 that would enhance its firm engagement against the dock planks. To accomplish this, bar 58 may increase its engaging surface area against the underside of the dock planks by having for instance, a relatively flat overall shape. Bar 58 may also have along its engaging surface, upwardly projecting teeth that are capable of digging into the underside of the dock planks so that bar 58 may firmly secure against the dock planks.

Figure 5:
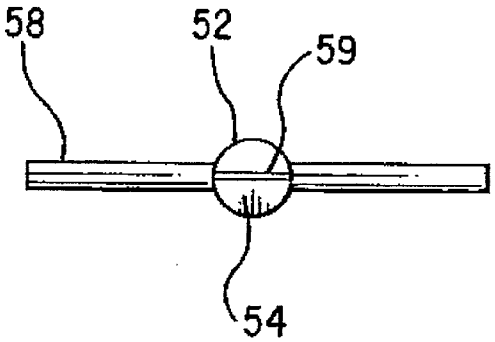
FIG. 5 is a top view of a bolt illustrated in FIG. 4.
Figure 6:
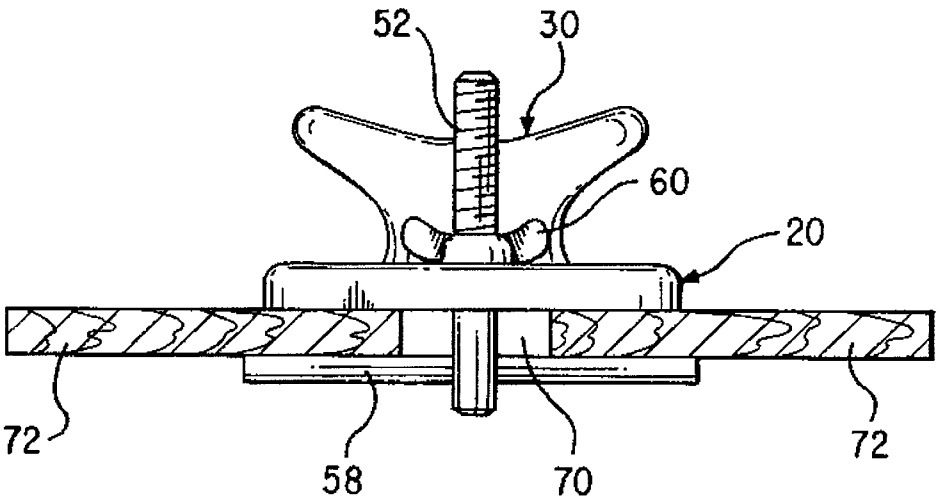
FIG. 6 illustrates an end view of the boat docking device shown in FIG. 1 secured to two dock planks.

Bolt 52, as illustrated in FIG. 5, further includes an indicator line 59 across the receiving end portion 54 at its end surface. Indicator line 59 is in a parallel alignment with bar 58 when bolt 52 is viewed from the side. When bar 58, shown in FIG. 6, is positioned within a gap 70 between two dock planks 72, indicator line 59 helps to determine the direction of bar 58 relative to the dock planks 72. In particular, prior to securing the base plate 20 against the dock planks 72, it is desirable that indicator line 59, and thus bar 58, be perpendicular to gap 70 so that the bar 58 may subsequently engage the underside of the dock planks 72 when bolt 52 is moved upward by nuts 60. Otherwise, bar 58 may be pulled from gap 70 without ever engaging the dock planks 72.

Interchangeable nuts 60 and 62 are made for mutual engagement along the length of externally screw threaded bolts 52 and 53. Like bolts 52 and 53, nuts 60 and 62 are preferably made of stainless steel so that in the presence of extreme environmental conditions, nuts 60 and 62 may remain non-corrosive. Of course, nuts 60 and 62 may be manufactured from other highly corrosion resistant materials. Nuts 60 and 62 may be of a conventional hexagonal shape or, as in the preferred embodiment, be in the shape of a wing nut. The use of wing nuts is highly desirable as, to a certain extent, faster and easier adjustment of nuts 60 and 62 along the length of bolts 52 and 53 may be permitted by the use of human fingers on the wings of nuts 60 and 62.

To assemble boat docking device 10, bolt 52 is first placed against one of the two openings 40 and 42 adjacent the bottom surface 24 of base plate 20. Bolt 52 is then inserted through the opening so that the receiving end portion 54 of bolt 52 may extend upward beyond the upper surface 22 to resemble FIG. 4. Nut 60 is next place on bolt 52 so that its internally screw threaded bore circumferentially sits about the receiving end portion 54. Bolt 60 may thereafter be threadedly rotated by human fingers onto bolt 52. The procedure may be repeated for bolt 53 with nut 62 across the remaining opening. Once assembled, the boat docking device 10 may be stored in its assembled form (FIG. 1) aboard a boat. In the event that a docking cleat is inconveniently located, inaccessible or unavailable at a plank dock, the boat docking device 10 may be readily retrieved and installed to provide a safe and convenient securing point on the dock. In one embodiment, nuts 60 and 62 cannot be removed entirely off of the bolts 52 and 53 so that the bolts cannot be pulled completely through the openings 40 and 42. Such a design prevents bolts 52 and 53 from being accidentally dropped into the water under the plank dock, as the docking device 10 is being attached to or removed from the plank dock.

To install the docking device 10, the base plate 20 is placed on the upper side of a plank dock so that bar 58, being relatively perpendicular to bolt 52, is aligned with gap 70 between dock planks 72. By allowing bar 58 to align with gap 70, bolt 52, in effect, will not be prevented from dropping through gap 70. Bolt 53 may also be similarly aligned. Once bolts 52 and 53 have dropped through gap 70 and the base plate 20 has engaged the top surface of the dock planks 72, bolts 52 and 53 may be axially rotated in a clockwise or counterclockwise manner so that the indicator line 59, and thus the bar 58, is approximately ninety degrees (90°) from its initial alignment with gap 70 (FIG. 6). In this position, bar 58 is ready to engage the underside of the dock planks 72. Thereafter, as nut 60 is threadedly advanced down bolt 52, bolt 52 tends to move upward relative to nut 60 so as to pull bar 58 toward the underside of the dock planks 72. Normally, the thickness of the dock planks 72 varies from dock to dock. Accordingly, the position of nut 60 along the externally screw threaded bolt 52 may be adjusted so that the distance between bar 58 and base plate 20 may correspond to the thickness of the dock planks 72.

Once the dock planks 72 are firmly sandwiched between bar 58 and the base plate 20, a bow or stern line may be secured around cleat 30. As discussed above, openings 40 and 42 are preferably spaced away from cleat 30. In particular, whereas the divergent arms 36 of cleat 30 are in alignment with two diagonally opposed corners on base plate 20, openings 40 and 42 are respectively adjacent to each of the two remaining diagonally opposed corners. By employing this arrangement, when bolts 52 and 53 are respectively situated within openings 40 and 42, bolts 52 and 53 are each at a point on the base plate 20 that is substantially furthest from cleat 30. As a result, neither bolts 52 nor 53 is sufficiently close to cleat 30 so as to interfere with the bow or stern line when the line is being wrapped around the divergent arms 36. Moreover, since bolts 52 and 53 extend significantly from beyond the top surface 22 of base plate 20 when the docking device 10 is secured against the dock planks 72, the diagonal positioning of bolts 52 and 53 on the base plate 20 may also reduce any accidental scraping against the bolts as the bow or stern line is being wrapped around cleat 30.

With at least one line secured around cleat 30, the firmly attached boat docking device 10 may experience strong pulling forces that otherwise may tend to displace the docking device 10 from its original position. However, as the bottom surface 24 is substantially flat, base plate 20 may act with adjustable means 50 to firmly and evenly engage the upper side of the dock planks 72 with stability. Moreover, in the presence of a downward force created by the oscillating motion of the wave, base plate 20 may also dig into the upper side of the dock planks 72 where the border 26 and the bottom surface 24 on base plate 20 form a right angle to further prevent any displacement in the direction of the pull. In the event that the docking device 10 does get displaced, the displacement is limited only to movement along the surface of the dock planks 72. This is because bar 58, being perpendicular disposed against the underside of the dock planks 72, prevents the boat docking device 10 from being pulled upward and away from the dock planks 72. The movement along the surface of the dock planks 72 may be further limited by the frame on which the dock planks 72 sit. Specifically, once the boat docking device 10 is pulled against the underlying frame, the frame acts as a barrier to prevent further movement by the docking device 10. Thus, once attached, the docking device 10 is certain not to be pulled from the plank dock.

Although capable of providing a safe securing point by itself, the boat docking device 10 may also be used to provide an added safe securing point in addition to a permanently attached cleat. When the boat docking cleat 10 is no longer needed to provide a securing point and the situation requires its removal, the securing process disclosed above may be reversed to easily remove the docking device 10 from the wooden planks 72.

While the invention has been described in connection with specific embodiments thereof, it will be understood that it is capable of further modification, and this application is intended to cover any variations, uses, or adaptations of the invention following, in general, in principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A boat docking device comprising;

a base plate for engaging an upper side of a plank dock, the base plate having a top surface, a bottom surface and a border;

the base plate having two spatially opposed openings situated adjacent to the border, the openings extending from the top surface to the bottom surface;

a cleat for receiving a line from a boat, the cleat being positioned between the openings on the top surface of the base plate;

two bolts for securing the base plate to the upper side of the plank dock, each bolt having a receiving end portion and a stop end portion, the receiving end portion extending upwardly through the openings, the stop end portion including a bar extending therethrough, the bar projecting in two directions is perpendicular relative to the bolt; and two nuts, each of which is circumferentially disposed about the receiving end portion for mutually engaging one bolt.

2. A boat docking device set forth in claim 1 wherein the bar is securely positioned across the bolt by crimping the bolt against the bar at an area immediately adjacent to the bar.

3. A boat docking device comprising:

a base plate for engaging an upper side of a plank dock, the base plate having a top surface, a bottom surface and a border;

the base plate having two spatially opposed openings situated adjacent to the border, the openings extending from the top surface to the bottom surface;

a cleat for receiving a line from a boat, the cleat being positioned between the openings on the top surface of the base plate;

two bolts for securing the base to the upper side of the plank dock, each bolt having a receiving end portion and a stop end portion, the receiving end portion extending upwardly through the openings, the stop end portion including an end surface and a bar attached to the end surface, the bar perpendicularly situated relative to the bolt; and two nuts, each of which is circumferentially disposed about the receiving end portion for mutually engaging one bolt.

4. A boat docking device set forth in claim 1 wherein each of the bolts includes an indicator line across its receiving end portion, the indicator line indicating the direction of the bar when the bolt is rotated about its axis.

5. A boat docking device comprising:

a base plate for engaging an upper side of a plank dock, the base plate having a top surface, a bottom surface and a border, the border defining a rectangular shape;

the base plate having two spatially opposed openings situated adjacent to the border, the openings extending from the top surface to the bottom surface;

a cleat for receiving a line from a boat, the cleat being disposed about a point between the two openings on the top surface of the base plate such that the cleat is in alignment with two diagonally opposing corners of the base plate;

two bolts for securing the base plate to the upper side of the plank dock, each bolt having a receiving end portion and a stop end portion, the receiving end portion extending upwardly through the openings; and two nuts, each of which is circumferentially disposed about the receiving end portion for mutually engaging one bolt.

6. A boat docking device set forth in claim 5 wherein each of the two spatially opposed openings are situated adjacent to each of two remaining diagonally opposite corners of the base plate such that a line connecting the two openings diagonally intersects the cleat.

7. A method for docking a boat to a plank dock, the method comprising:

(a) providing a boat docking device comprising:

a base plate for engaging an upper side of a plank dock, the base plate having a top surface, a bottom surface and a border;

the base plate having two spatially opposed openings situated adjacent to the border, the openings extending from the top surface to the bottom surface;

a cleat for receiving a line, the cleat being positioned between the openings on the top surface of the base plate;

two bolts for removably securing the base plate to the upper side of the plank dock, each bolt having a receiving end portion and a stop end portion, the receiving end portion having an indicator line and extending upwardly through the openings, the stop end portion including an aperture and a bar securely extending across the aperture, the bar projecting in two directions from the bolt is perpendicular relative to the bolt, the bar also being in parallel alignment with the indicator line; and two nuts, each of which is circumferentially disposed about the receiving end portion for mutually engaging the bolt;

(b) placing the base plate on the plank dock so that the bar across each stop end portion aligns with a gap between two dock planks;

(c) inserting each bolt through the gap and allowing the base plate to engage the dock planks;

(d) rotating each bolt about its axis until the indicator line is perpendicular relative to the gap;

(e) tightening each nut while holding onto the bolt until the dock planks are firmly secured between the bar and the base plate; and (f) wrapping the line from the boat around the cleat so as to prevent the boat from drifting away from the dock.

8. A method as set forth in claim 7 further comprising the steps of:

(g) unwrapping the line from the cleat; and (h) loosening each nut while holding onto the bolt until the dock planks are released from between the bar and the base plate.

9. A boat docking device comprising:

a base plate for engaging an upper side of a plank dock, the base plate having a top surface, a bottom surface and a border;

the base plate having two spatially opposed openings situated adjacent to the border, the openings extending from the top surface to the bottom surface;

a cleat for receiving a line from a boat, the cleat being positioned between the openings on the top surface of the base plate;

two bolts for removably securing the base plate to the upper side of the plank dock without the use of tools, each bolt having a receiving end portion and a stop end portion, the receiving end portion extending upwardly through the openings, the stop end portion including a bar extending therethrough, the bar projecting in two directions is perpendicular relative to the bolt; and two nuts, each of which is circumferentially disposed about the receiving end portion for mutually engaging one bolt.

10. A boat docking device set forth in claim 9 wherein the bar is securely positioned across the bolt by crimping the bolt against the bar at an area immediately adjacent to the bar.

11. A boat docking device set forth in claim 9 wherein each of the bolts includes an indicator line across its receiving end portion, the indicator line indicating the direction of the bar when the bolt is rotated about its axis.

12. A boat docking device comprising:

a base plate for engaging an upper side of a plank dock, the base plate having a top surface, a bottom surface and a border;

the base plate having two spatially opposed openings situated adjacent to the border, the openings extending from the top surface to the bottom surface;

a cleat for receiving a line from a boat, the cleat being positioned between the openings on the top surface of the base plate;

two bolts for removably securing the base plate to the upper side of the plank dock without the use of tools, each bolt having a receiving end portion and a stop end portion, the receiving end portion extending upwardly through the openings the stop end portion including an end surface and a bar attached to the end surface, the bar being perpendicularly situated relative to the bolt; and two nuts, each of which is circumferentially disposed about the receiving end portion for mutually engaging one bolt.

13. A boat docking device comprising;

a base plate for engaging an upper side of a plank dock, the base plate having a top surface, a bottom surface and a border;

the base plate having two spatially opposed openings situated adjacent to the border, the openings, extending from the top surface to the bottom surface, are diagonally situated such that each opening is adjacent to each of two diagonally opposing corners of the base plate, the border of the base plate, defining a rectangular shape;

a cleat for receiving a line from a boat, the cleat, being positioned between the openings on the top surface of the base plate, is disposed about a point between the two openings such that the cleat is in alignment with two diagonally opposing corners of the base plate;

two bolts for removably securing the base plate to the upper side of the plank dock without the use of tools, each bolt having a receiving end portion and a stop end portion, the receiving end portion extending upwardly through the openings; and two nut, each of which is circumferentially disposed about the receiving end portion for mutually engaging one bolt.

14. A boat docking device set forth in claim 13 wherein each of the two spatially opposed openings is situated adjacent to each of two remaining diagonally opposite corners of the base plate such that a line connecting the two openings diagonally intersects the cleat.

* * * * *

UNITED STATES PATENT AND TRADEMARK OFFICE

CERTIFICATE OF CORRECTION

PATENT NO. : 5,542,367

DATED : August 6, 1996

INVENTOR(S) : Eugene W. DuBois, III, Ronald J. Doria, and Robert J. Butler

It is certified that error appears in the above-indentified patent and that said Letters Patent is hereby corrected as shown below:

Col. 8, line 49, insert --being-- after "bar".
Col. 10, line 46, delete the comma after "plate".

Signed and Sealed this

Twenty-ninth Day of October 1996

*Attest:*

Bruce Lehman

BRUCE LEHMAN

*Attesting Officer*

*Commissioner of Patents and Trademarks*